United States Patent [19]

Konaka

[11] 4,421,232

[45] Dec. 20, 1983

[54] BOTTLE PACKAGING BOX

[75] Inventor: Yukio Konaka, Kanazawa, Japan

[73] Assignee: Shibuya Machine Company Ltd., Kanazawa, Japan

[21] Appl. No.: 341,029

[22] Filed: Jan. 20, 1982

[30] Foreign Application Priority Data

Aug. 5, 1981 [JP] Japan ..... 56-116401[U]

[51] Int. Cl.[3] ..... B65D 75/08; B65D 75/04; B65D 71/00; B65D 5/02

[52] U.S. Cl. ..... 206/434; 206/157; 206/196; 206/154; 24/572

[58] Field of Search ..... 206/434, 154, 155, 156, 206/157, 158, 196; 24/204

[56] References Cited

U.S. PATENT DOCUMENTS

| | | | |
|---|---|---|---|
| 3,375,968 | 4/1968 | Weiss | 206/196 |
| 3,589,593 | 6/1971 | Weiss | 229/40 |
| 3,640,448 | 2/1972 | Wood | 206/158 |
| 3,977,518 | 8/1976 | Arneson | 206/434 |
| 4,093,116 | 6/1978 | Watkins et al. | 24/204 |

FOREIGN PATENT DOCUMENTS

| | | | |
|---|---|---|---|
| 1491526 | 7/1967 | France | 206/154 |

*Primary Examiner*—William T. Dixson, Jr.
*Assistant Examiner*—Brenda J. Ehrhardt
*Attorney, Agent, or Firm*—Flynn, Thiel, Boutell & Tanis

[57] ABSTRACT

A packaging box is assembled from a blank including a trapezoidal locking tab formed adjacent to one end edge of the blank by a cut formed therein. An insert tab extends from the other end edge of the blank and can be inserted into an opening which is formed when the locking tab is folded. When an article or articles are packaged, the insert tab is inserted into the opening from the outside while tilting the locking tab, and when fitted into the opening, the insert tab is urged by gravity of the articles, whereby it is locked in place. In this manner, the packaging box is rigidly maintained in its assembled condition.

5 Claims, 4 Drawing Figures

BOTTLE PACKAGING BOX

FIELD OF THE INVENTION

The invention relates to a portable packaging box which is folded from a blank for containing a plurality of containers such as bottles.

BACKGROUND OF THE INVENTION

A packaging box of the kind described is generally assembled by disposing the opposite ends of the blank in overlapping relationship with each other in a region which defines the bottom of the box and adhesively bonding the overlapping portions together. Alternatively, for a packaging box in which two rows of aligned bottles are received, one end of the blank is folded to provide a partition interposed between the rows of bottles while the other end of the blank is disposed in overlapping relationship and adhesively bonded to the lower surface of the bottom adjacent to the fold line.

In either construction, the box configuration is defined by adhesively bonding the opposite ends of the blank which are disposed in overlapping relationship in a region corresponding to the bottom thereof. Accordingly, the mechanical strength of the box depends on the bonding strength, presenting a problem that boxes cannot be obtained which have a sufficient size to receive large containers or which have a sufficient strength, because of the limited material available for the blank.

To provide a rigid bond between the overlapping portions in a bottom region, it has been proposed to provide a panel of the blank which is located outside in the overlapping region and which is formed with an insert tab, which is in turn folded into an opening formed in the inner or the other panel, thus locking the both panels together. However, because the lock condition is achieved by merely inserting the tab into the mating opening, the conventional locking mechanism suffers from disadvantages that the tab is apt to be disengaged when an external force is applied and the locking action is unreliable in operation. As an overall effect, the locking means merely serves as auxiliary means to add to the strength of the bonding means provided in the overlapping region.

SUMMARY OF THE INVENTION

Therefore, it is an object of the invention to provide a packaging box capable of providing a reliable locking action without requiring any special bonding means. This object is achieved by allowing articles to be packaged by the blank to cause an insert tab to be locked into an opening.

It is another object of the invention to alleviate any collision between articles during transportation, by forming an opening substantially centrally in an upper bottom panel of the blank adjacent to one end thereof for receiving an insert tab formed adjacent to the other end of the blank, with the insert tab defining a partition interposed between two adjacent articles to be contained in the box.

Other objects and advantages of the invention will become apparent from the following description with reference to the attached drawings.

DESCRIPTION OF EMBODIMENTS

Figure 1:
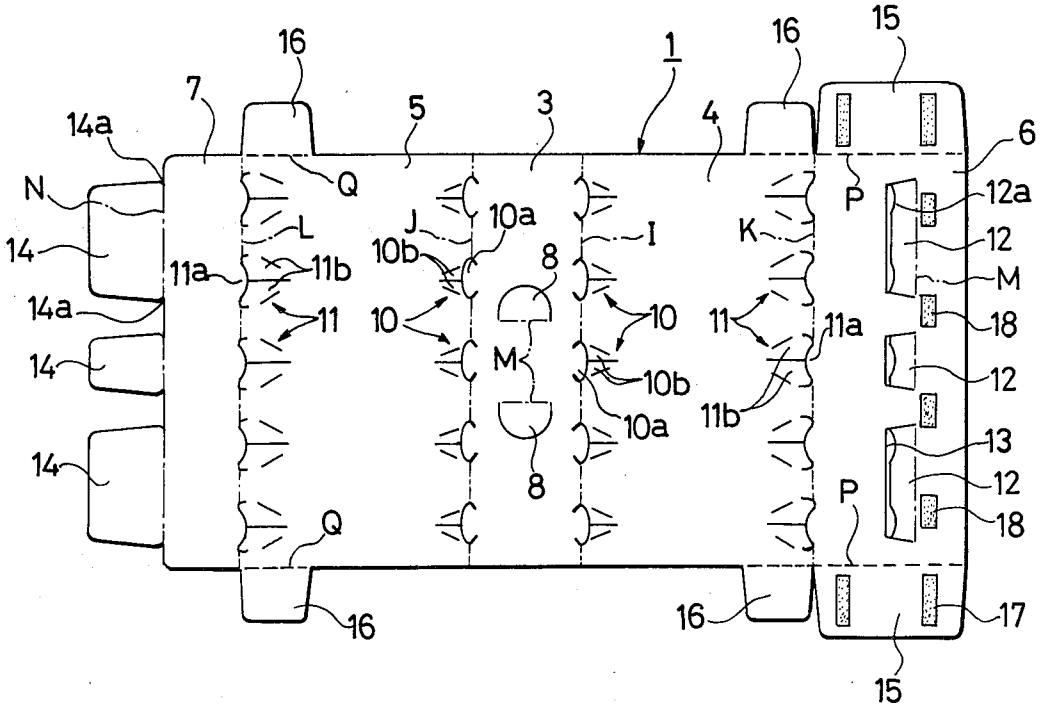
FIG. 1 is a plan view showing a blank according to one embodiment of the invention.
Figure 2:
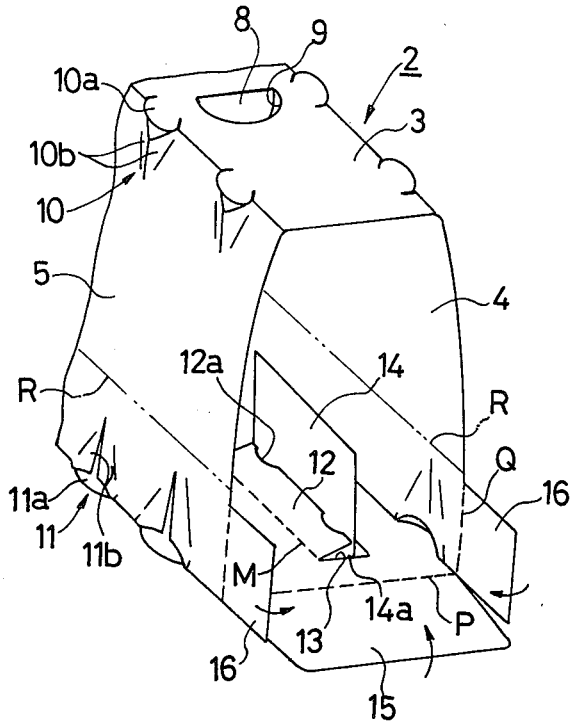
FIG. 2 is a perspective view of a packaging box which is assembled from the blank shown in FIG. 1, showing the essential parts thereof.

The invention will now be described with reference to several embodiments thereof illustrated in the drawings. It is to be understood that an assumption is made for the embodiment shown in FIG. 1 that a packaging box shown is to receive two rows, each including five bottles C aligned with each other. FIG. 1 shows a development of the packaging box or a blank 1 while FIG. 2 shows essential parts of a packaging box 2 which is assembled by folding from the blank. An area defining a top panel 3 of the box 2 is defined substantially centrally in the blank 1 by a pair of fold lines I, J, and right- and left-hand side panels 4, 5 of the box 2 are disposed in contiguous relationship with the opposite sides of the top panel. The outer boundary of the right-hand side panel 4 is defined by another fold line K, which also defines an upper bottom panel 6 while the outer boundary of the left-hand side panel 5 is defined by a further fold line L, which also defines a lower bottom panel 7. By folding the blank along these fold lines I, J, K and L, the box can be assembled.

The top panel 3 is centrally formed with a pair of semi-circular tabs 8 which have their diametrically extending edges disposed in opposing relationship. These tabs can be formed by forming a semi-circular cut into the blank 1 and forming a fold line along the diametrical edge of the tab. When assembled, the tabs 8 are bent or folded down, thus producing semi-circular openings 9 which can be conveniently engaged by fingers of a carrying person during transportation. In a particular design, the blank is configured so that the inside of the thumb and the index finger bear against the tabs 8 for convenience of carrying about the box 2.

A plurality of bottle mouth retainers 10, which are five in number in the example illustrated, are formed along each of the fold lines I, J defining the boundary between the top panel 3 and the side panels 4, 5. Each of the retainers 10 includes a top abutment **10*a* against which the top end of the bottle mouth bears, and a pair of lateral abutments 10*b*, which are chevron-shaped and against which the lateral portion of the bottle mouth bears while slightly projecting outwardly beyond the general plane of the side panels when the box is assembled as shown in FIG. 2. The top abutment 10*a* is formed by an arcuate cut formed into the blank 1 so as to bulge toward the side panel 4 or 5 beyond the fold line I or J, and radial cuts formed into the blank and continuing with the opposite ends of the arcuate cut. On the other hand, each of the lateral abutments 10*b*** is substantially triangular in configuration, and is formed by a cut extending from a central point on the arcuate cut in a direction perpendicular to the fold line I or J, and a pair of cuts interposed between the remote end of the perpendicular cut and the opposite ends of the arcuate cut.

A plurality of bottle bottom retainers 11 are formed along each of the fold lines K, L defining the side panels 4, 5, generally in alignment with the individual bottle mouth retainers 10. When assembled, each of the bottle bottom retainers 11 is located immediately below the bottle mouth retainer 10 so as to hold an edge of the bottle bottom in place. Structurally, it is constructed generally in the similar manner as the bottle mouth retainer 10, and comprises a web 11*a* projecting slightly outwardly of the side panel 4 or 5 to support the bottom of the bottle, and a pair of lateral abutments 11*b* against which a lateral portion of the bottle, disposed toward its bottom, bears. Specifically, the web 11*a* is defined by an arcuate cut formed into the blank 1 so as to loop outwardly toward the side panel 4 or 5 beyond the fold line K or L while each of the lateral abutments 11*b* is substantially trapezoidal in configuration and is formed by a cut formed into the side panel and extending from a central point on the arcuate cut, which forms the web 11*a*, in a direction perpendicular to the fold line K or L, a pair of short cuts formed adjacent to the opposite ends of the arcuate cut and extending in a direction perpendicular to the fold line K or L, and another cut formed between the pair of short cuts to permit a part of the blank to be folded.

The upper bottom panel 6 is formed with three trapezoidal locking tabs 12, each of which is formed by providing a substantially channel-shaped cut into the upper bottom panel 6 and forming a fold line M along the remaining or right-hand side. It will be noted that for the upper and lower locking tabs, a pair of arcuate notches 12*a* are formed adjacent to the opposite ends of the left-hand side. The middle tab is formed with a single notch 12*a*. Consequently, when the locking tab 12 is folded along the fold line M, there is formed a trapezoidal opening 13, thus permitting the insertion of an insert tab 14 to be described later. As shown, two of the three locking tabs 12, which are located endmost, have a greater size than the middle one in order to permit them to be locked simultaneously by a pair of bottles C.

The lower bottom panel 7 is formed with three insert tabs 14 in a manner corresponding to the locking tabs. The insert tabs 14 are trapezoidal in configuration, slightly tapering toward their free end. It will be noted that a fold line N is formed along the base end, or the end of the insert tabs 14 where they adjoint with the lower bottom panel 7, and a pair of notches 14*a* are formed in this end of each insert tab 14 along the fold line N. It is to be noted that the greatest width of the insert tab 14, namely, the width at its base end is substantially equal to the width of the bottom of the trapezoidal opening 13 while the length of the segment of the fold line N in each insert tab 14, namely, the length of the base end of the tab from which the combined length of the notches 14*a* is subtracted, is substantially equal to the width of the top of the trapezoidal opening 13. Accordingly, during the assembly, the insert tabs 14 may be inserted into the corresponding trapezoidal openings 13 in their broader regions, and after the notches 14*a* are engaged with the edge of the trapezoidal openings 13, the insert tabs 14 may be shifted into engagement with the narrower portions of the trapezoidal openings 13. As a result, the insert tabs 14 are locked to the upper bottom panel 6 through the notches 14*a*.

As shown, the upper bottom panel 6 is contiguously formed with a pair of end panels 15 which partly close the lateral openings of the assembled box. Each of the side panels 4, 5 is formed with a pair of webs 16, and the end panels 15 are brought into overlapping relationship with these webs. Specifically, during assembly, the end panels 15 are folded in an upward direction along interrupted fold line P, and the webs 16 are folded inwardly along interrupted fold lines Q to permit them to be adhesively secured to the end panels. The combination of the end panels 15 and the webs 16 prevent articles contained in the packaging box from falling down. It is also contemplated that the blank may be provided with interrupted lines along imaginary lines R shown in FIG. 2 so that the upper portion of the assembled box may be removed by cutting along these lines, thereby utilizing the box as a tray for purpose of displaying goods.

By way of modifications, areas 17 shown on the end panels 15 are provided to apply an adhesive thereto. However, these areas may be provided on the webs 16. Alternatively, the end panels 15 and the webs 16 may be entirely removed. Also adhesive areas 18 on the upper bottom panel 6 may be omitted.

Figure 3:
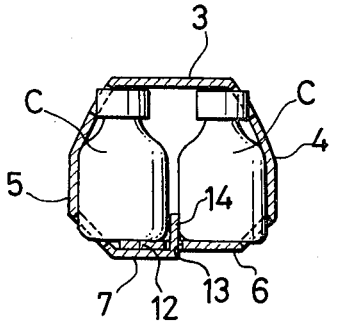
FIG. 3 is a vertical section, illustrating containers packaged in the box.

FIG. 3 is a simplified illustration of containers C received in a packaging box formed from the blank 1. It will be seen that the insert tab 14 extends between a pair of oppositely located containers C to provide a partition therebetween. In this manner, these containers are firmly secured in place, and the likelihood that they may collide against each other during transportation can be alleviated. The locking tabs 12 are held down or against the lower bottom panel 7 by gravity of the containers C, thus preventing a movement of insert tabs 14. A withdrawal of the insert tabs 14 from the trapezoidal openings 13 is prevented as a result of their notches 14*a* engaging with the edge of the openings 13. As an overall effect, the combination of the insert tabs 14 and the locking tabs 12 permits the box to be rigidly maintained in its assembled condition.

Figure 4:
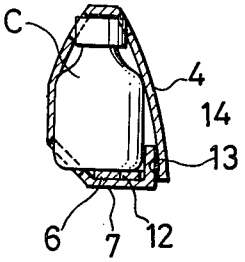
FIG. 4 is a similar vertical section of another embodiment of the invention.

FIG. 4 shows another embodiment of the invention which is utilized to pack a single row of containers C. It will be seen that the insert tabs 14 are held against the side panel 4. In other respects, the arrangement is fundamentally similar to that mentioned above in connection with the first embodiment.

It should be understood that the use of the invention is not limited to packaging bottles, but that the invention is equally applicable to packaging of cans and paper containers as are used in the form of milk packs or juice packs.

While the invention has been illustrated and described above in connection with certain embodiments thereof, other changes, modifications and alterations will be obvious to one skilled in the art. Hence, it is to be clearly understood that the scope of the invention be solely defined by the appended claims.

The embodiments of the invention in which an exclusive property or privilege is claimed are defined as follows:

1. A packaging box assembled from a generally planar sheet material blank, wherein said blank comprises:

a plurality of fold lines dividing said blank into side, top, first and second bottom panels;

a plurality of openings in one of said bottom panels;

a plurality of insert tabs provided on the other of said bottom panels and being alignable for entry into said openings, each said insert tab having a generally trapezoidal shape and being connected to an edge of said other bottom panel about a further fold line, means defining a notch in opposite lateral edges of each said insert tab, each said opening in said one bottom panel having a lateral width less than the segment of said insert tab adjacent said further fold line; and each said opening having means along one edge thereof defining a locking tab pivotal into and out of the plane of said one bottom panel, a folding of said blank about said fold lines effecting a placement of said other bottom panel beneath said one bottom panel so that an entry of an aligned said insert tab into a said opening will effect an upward deflection of said locking tab out of said plane of said one bottom panel, said notches receiving therein a lateral edge of each said opening, a downward urging of said locking tab caused by the weight of a container housed within said box effecting a tight locking of said insert tab into said opening.

2. A packaging box according to claim 1, wherein said blank includes means defining additional panels which when said blank is folded about said fold lines to form said box define end panels of said box.

3. A packaging box according to claim 1, in which said first and second bottom panels are joined to the opposite ends of said blank through respective folding lines, the upper one of said bottom panels having said openings symmetrically cut therein relative to the width of said blank and each said insert tab extending from the end edge of said lower one of said bottom panels.

4. A packaging box according to claim 3, in which for receiving a pair of rows of aligned articles in said box and which are placed on top of said upper one of said bottom panels, said insert tab is located between the articles in said rows.

5. A packaging box according to claim 1, in which a single row of aligned articles is placed on top of said upper one of said bottom panels so as to be packaged in said box and said insert tabs are located along one side of said aligned articles.

* * * * *